US006880197B2

(12) United States Patent
Katz et al.

(10) Patent No.: US 6,880,197 B2
(45) Date of Patent: Apr. 19, 2005

(54) DISPOSABLE TOILET CLEANING DEVICE WITH EXTENDABLE HANDLE

(76) Inventors: Susan Katz, 2828 N. Burling St., Apartment 406, Chicago, IL (US) 60657; Cheryl Bersano, 1037 Dunlop Ave., Forest Park, IL (US) 60130

( * ) Notice: Subject to any disclaimer, the term of this patent is extended or adjusted under 35 U.S.C. 154(b) by 0 days.

(21) Appl. No.: 10/403,929

(22) Filed: Mar. 31, 2003

(65) Prior Publication Data

US 2004/0187241 A1 Sep. 30, 2004

(51) Int. Cl.[7] ..... A46B 15/00; A47L 13/10; A47L 13/12

(52) U.S. Cl. ..... 15/144.4; 15/104.94; 15/160; 15/244.1

(58) Field of Search ..... 15/144.4, 160, 15/210.1, 172, 104.94, 244.1

(56) References Cited

U.S. PATENT DOCUMENTS

| | | | | | |
|---|---|---|---|---|---|
| 719,383 | A | | 1/1903 | Shych | |
| 1,300,884 | A | * | 4/1919 | Schwertz | 15/144.4 |
| 1,572,885 | A | * | 2/1926 | Corbett | 15/187 |
| 1,709,622 | A | | 4/1929 | Justis | |
| 1,951,313 | A | * | 3/1934 | Peyser | 15/244.1 |
| D155,489 | S | | 10/1949 | DeMesquita | |
| 3,176,317 | A | | 4/1965 | Kelseaux | |
| 3,364,512 | A | | 1/1968 | Yamashita et al. | |
| 3,911,507 | A | | 10/1975 | Johnson | |
| 4,135,274 | A | * | 1/1979 | Freeman | 15/244.1 |
| 4,329,755 | A | * | 5/1982 | Alissandratos | 15/144.4 |
| 4,961,661 | A | * | 10/1990 | Sutton et al. | 401/6 |
| 5,144,712 | A | * | 9/1992 | Hansel et al. | 15/167.1 |
| 5,471,697 | A | | 12/1995 | Daconta | |
| 5,537,777 | A | | 7/1996 | Geeting | |
| 5,823,592 | A | * | 10/1998 | Kalidindi | 294/24 |
| D404,924 | S | | 2/1999 | Schmidt | |
| 5,888,002 | A | | 3/1999 | Fenstersheib | |
| 5,915,435 | A | | 6/1999 | Wilen et al. | |
| D414,528 | S | | 9/1999 | Bocock et al. | |
| 6,134,738 | A | | 10/2000 | Weber et al. | |
| 6,226,828 | B1 | | 5/2001 | Lin | |
| 6,269,515 | B1 | | 8/2001 | Varma | |
| 6,393,646 | B1 | * | 5/2002 | Beers et al. | 15/144.4 |
| 6,415,470 | B1 | * | 7/2002 | Ramrattan | 15/144.4 |
| 6,523,550 | B1 | * | 2/2003 | McCormick | 132/320 |
| 2003/0061676 | A1 | * | 4/2003 | Warren | 15/176.2 |
| 2004/0074033 | A1 | * | 4/2004 | Steinberg | 15/144.4 |

* cited by examiner

*Primary Examiner*—Randall Chin
(74) *Attorney, Agent, or Firm*—Chase Law Firm, L.C.

(57) ABSTRACT

A disposable toilet cleaning device is provided to clean the surfaces of a toilet which includes a handle and a telescoping arm which extends from the handle for cleaning a toilet. A cleaning head is secured to the free end of the telescoping arm and may include a cleaning chemical to effectuate cleaning of the toilet. The telescoping arm may include a flexible neck for positioning the brush head for cleaning the toilet. The components of the toilet brush may be made of a paper product and/or plastic material suitable for one use.

9 Claims, 1 Drawing Sheet

DISPOSABLE TOILET CLEANING DEVICE WITH EXTENDABLE HANDLE

BACKGROUND OF THE INVENTION

This invention generally relates to cleaning tools and, in particular, to a toilet cleaning device or tool which is disposable and includes a telescoping handle and an extendable cleaning head.

The typical toilet bowl cleaning device or brush provided in the prior art is made of plastic and is stored next to the toilet in the bathroom in its own storage case or brush hanger. The brush and storage case is typically unsightly and presents the further dilemma of handling the brush after use and cleaning the brush and storage case. A need exists for a toilet bowl cleaning device that does not need to be cleaned and does not require storage after use.

SUMMARY OF THE INVENTION

The present invention includes a handle with an extendable arm and compact cleaning head. The cleaning head may expand upon release from the handle or may be initially dispose outside the handle. The cleaning device handle may be made of cardboard or other disposable material with the head being made of plastic, foam rubber, scouring pad material, nylon or other fibers and/or materials. After use, the cleaning device may be disposed of in a trash receptacle.

DETAILED DESCRIPTION

Figure 1:
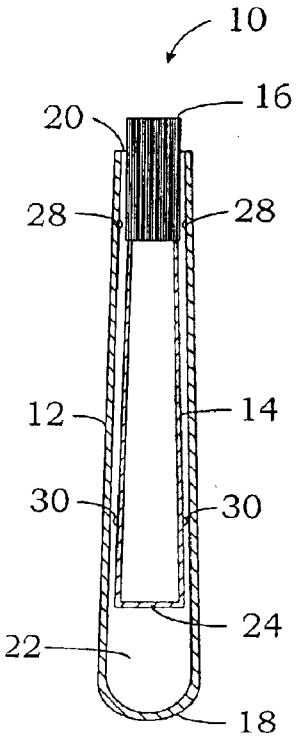
FIG. 1 is a sectional elevational view of the cleaning device of the present invention in the nested position with a brush head.
Figure 2:
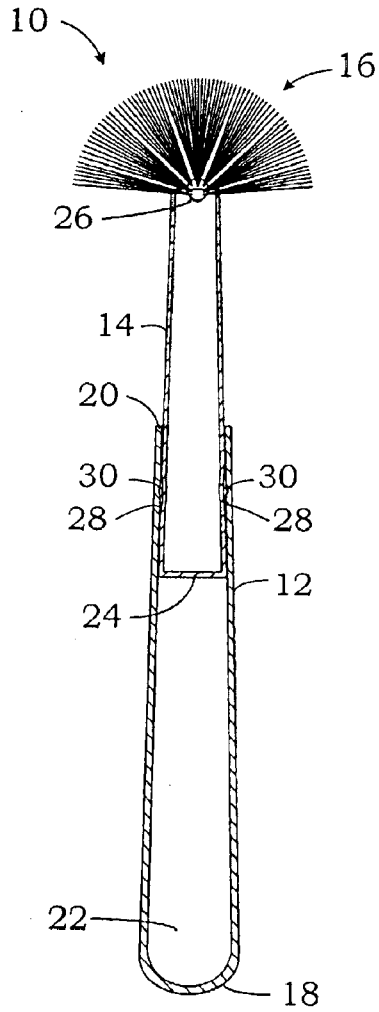
FIG. 2 is a sectional elevational view of the cleaning device of FIG. 1 shown in the extended position.

Referring to FIGS. 1 and 2, a disposable toilet cleaning device of the present invention is generally indicated by reference numeral 10. Disposable toilet cleaning device 10 includes a handle or outer tube 12, an extendable or telescoping arm 14 and an expandable brush head 16. Handle 12 is generally hollow and tapers from a base portion 18 to an open end 20 opposite the base 18. The hollow cavity 22 of handle 12 is sized to accommodate extendable arm 14 nested therein in the stored position as shown in FIG. 1. Extendable arm 14 is also tapered generally along the same lines as the taper for handle 12. Extendable arm 14 is tapered from its base 24 to its end 26 extending from the open end 20 of handle 12. Generally, the base 24 of extendable arm 14 is wider than the open end 20 of handle 12.

A foldable, self-expanding brush head 16 is secured to the end 26 of extendable arm 14. Brush head 16 includes a plurality of cleaning bristles. The brush head 16 is compressed and at least partially contained within the handle 12 in the stored position as shown in FIG. 1.

Handle 12 may include a locking ridge 28 around its inside diameter extending into cavity 22 positioned near the open end 20 of handle 12. Similarly, extendable arm 14 may include a locking ridge 30 extending outwardly from its outer diameter positioned near its base 24.

Handle 12 and arm 14 may be made of sturdy cardboard or other disposable material and coated with a wax or plastic film to allow sufficient use when exposed to water or other cleaning chemicals used to clean a toilet before disposing of the toilet cleaning device 10 in a trash receptacle. Brush head 16 may be made of plastic, nylon or other resilient material that provides sufficient strength to be used as a scrub brush.

In operation, the user of the cleaning device 10 pulls and extends the exposed portion of the brush head 16 axially outwardly from handle 12 until the locking ridge 30 of the extendable arm 14 passes over the locking ridge 28 of the handle 12. The outer diameter of the larger end 24 of arm 14 is gripped by the inner diameter near the open end 20 of handle 12. The compressed brush head 16 expands upon being pulled from the handle 12 as shown in FIG. 2. The cleaning device 10 may now be used to clean a toilet. The locking ridges 28 and 30 prevent the expandable arm 14 from retracting back into the handle 12 during use. If locking ridges 28 and 30 are not included, the outside diameter of arm 14 compresses against the inside diameter of handle 12 to securely hold arm 14 in the extended position.

Figure 3:
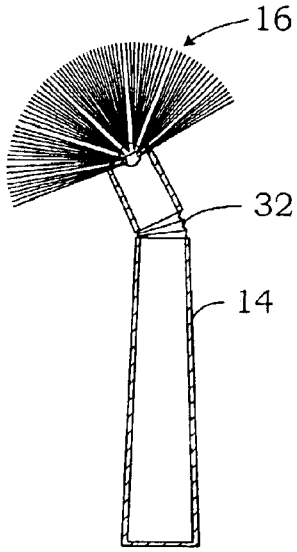
FIG. 3 is a partial view of the extendable arm of the cleaning device of FIG. 1 with a flexible neck.

Referring to FIG. 3, an extendable arm 14 may include a flexible neck 32 to allow the brush head 16 to be positioned in many positions to allow the user to clean under the rim of the toilet, for example. The flexible neck 32 may be axially aligned with extendable arm 14 when the disposable cleaning device 10 is in the stored position, and may be repositioned or bent as shown in FIG. 3 when in the extended position.

Figure 4:
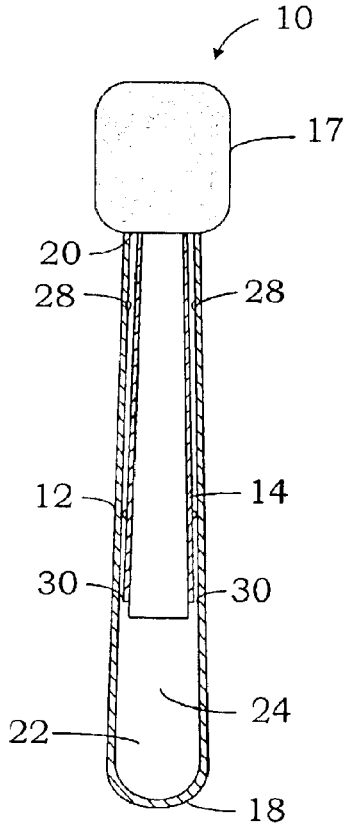
FIG. 4 is a sectional elevational view of the cleaning device of the present invention with a pad cleaning head.

Referring to FIG. 4, a cleaning or scouring head 17 may be secured to the end 26 of extendable arm 14. Cleaning pad 17 may include a foam rubber sponge on one side and a scouring pad on the opposite side for added versatility. The cleaning head 16 may be fully extended from the handle 12 as shown in FIG. 4 or may be compressed and at least partially contained within the handle 12 in a stored position as the brush head 16 shown in FIG. 1. The cleaning head 17 or brush head 16 may include a toilet cleaning chemical embedded within either of the heads for immediate use without the need for other cleaning supplies.

Figure 5:
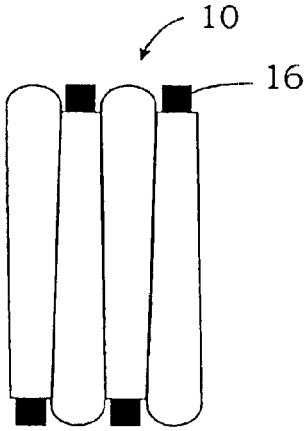
FIG. 5 is a plan view of four cleaning devices each of which are shown in FIG. 1 and are shown reduced in size.
Figure 6:
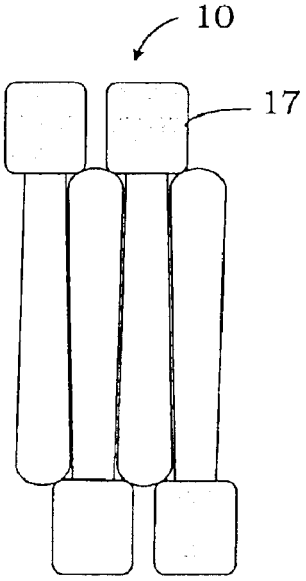
FIG. 6 is a plan view of four cleaning devices each of which are shown in FIG. 4 and are shown reduced in size.

Referring to FIGS. 5 and 6, the compact design and shape of the disposable toilet cleaning device 10 aids in packaging two or more cleaning devices 10 together for immediate use. The disposable toilet cleaning devices 10 may be alternately positioned head to toe and in multiple layers to conveniently package the disposable cleaning devices 10.

It is to be understood that while a certain form of the present invention has been illustrated and described, it is not limited thereto except insofar as such limitations are included in the following claims.

Having thus described the invention, what is claimed as new and desired to be secured by Letters Patent is:

1. A device for cleaning a toilet comprising:

an elongated generally hollow handle having a first end opposite an open second end, said ends defining a longitudinal axis therebetween, said first end adapted for manually grasping by a user, said handle tapering from said first end to said open second end, an elongated arm having opposite first and second ends defining a longitudinal axis therebetween, said arm tapering from said first end to said second end, said arm disposed within said hollow handle and slidable between a stored position and an extended position wherein said second end of said arm extends from said handle, and a cleaning head secured to the second end of said arm for cleaning said toilet, said cleaning head having a folded position wherein said cleaning head partially extends from said handle second open end when said arm is in said stored position, and an expanded position wherein said cleaning head fully extends from said handle second open end when said arm is in said extended position.

2. The cleaning device as claimed in claim 1 wherein said second open end of said handle has a predetermined cross sectional area generally perpendicular to said longitudinal axis of said handle, wherein said first end of said arm has a cross sectional area generally perpendicular to said longitudinal axis of said arm, and wherein said cross sectional area of said first end of said arm is greater than said cross sectional area of said second open end of said handle.

3. The cleaning device as claimed in claim 1 further comprising:

a first locking ridge proximal said second open end of said handle and extending generally inwardly to said hollow handle, a second locking ridge proximal said first end of said arm and extending generally outwardly from said arm, said second locking ridge passing over said first locking ridge when said arm is moved from said stored position to said extended position wherein said locking ridges lock said arm in said extended position.

4. The cleaning device as claimed in claim 1 wherein said arm includes a flexible neck proximal said second end of said arm movable from a position along said longitudinal axis to a position at an angle to said longitudinal axis.

5. The cleaning device as claimed in claim 1 wherein said handle and arm are made of cardboard.

6. The cleaning device as claimed in claim 1 wherein said cleaning head includes a cleaning chemical to effectuate cleaning of said toilet.

7. A device for cleaning a toilet comprising:

an elongated handle having first and second opposing ends defining a longitudinal axis therebetween, said first end of said handle adapted for grasping by a user, said handle tapering from said first end to said second end, said handle having a telescoping member slidably secured within said handle and movable between a stored position and an extended position along said longitudinal axis of said handle wherein a free end of said telescoping member extends from said second end of said handle, said telescoping member having a flexible neck proximal said free end of said telescoping member, wherein said flexible neck includes a means for locking said neck in a flexed position at an angle to said longitudinal axis, a cleaning head secured to said free end of said telescoping member, and means for locking said telescoping member in said extended position, wherein said handle and telescoping member are made of a paper product.

8. The cleaning device as claimed in claim 7 wherein said cleaning head moves from a folded position partially extending from said second end of said handle when said telescoping member is in said stored position, and an expanded position when said telescoping member is in said extended position.

9. The cleaning device as claimed in claim 7 wherein said cleaning head includes a cleaning chemical to effectuate cleaning of said toilet.

* * * * *

UNITED STATES PATENT AND TRADEMARK OFFICE

CERTIFICATE OF CORRECTION

PATENT NO. : 6,880,197 B2
APPLICATION NO. : 10/403929
DATED : April 19, 2005
INVENTOR(S) : Susan Katz and Cheryl Bersano It is certified that error appears in the above-identified patent and that said Letters Patent is hereby corrected as shown below:

Column 2, line 59, insert a comma after the word “end”.

Column 2, line 60, delete “opposite” and substitute --and--.

Column 2, line 64, delete “opposite” and substitute --opposed--.

Signed and Sealed this

Eleventh Day of July, 2006

JON W. DUDAS
*Director of the United States Patent and Trademark Office*